United States Patent [19]

Borstelmann

[11] 4,201,249

[45] May 6, 1980

[54] MACHINE FOR THE FILLING OF LIQUIDS INTO CONTAINERS

[75] Inventor: Wolfgang Borstelmann, Dortmund, Fed. Rep. of Germany

[73] Assignee: Holstein und Kappert GmbH, Dortmund-Wambel, Fed. Rep. of Germany

[21] Appl. No.: 949,471

[22] Filed: Oct. 10, 1978

Related U.S. Application Data

[63] Continuation-in-part of Ser. No. 913,867, Jun. 8, 1978, Pat. No. 4,146,065.

[30] Foreign Application Priority Data

Oct. 11, 1977 [DE] Fed. Rep. of Germany ..... 2745641

[51] Int. Cl.[2] ..... B65B 31/00

[52] U.S. Cl. ..... 141/39; 141/302

[58] Field of Search ..... 141/4–8, 141/37, 39, 54, 46, 192, 197, 198, 286, 40, 49, 52, 53, 302, 57, 58, 63, 64, 227, 303, 144–153, 95, 128

[56] References Cited

U.S. PATENT DOCUMENTS 3,799,219 3/1974 Uth et al. ..... 141/39

*Primary Examiner*—Houston S. Bell

*Attorney, Agent, or Firm*—Michael J. Striker

[57] ABSTRACT

A filling machine for filling of liquids into a container has a vessel and filling elements operatively connected with the liquid vessel and including a liquid input conduit, an advance and return gas conduit, and a pressure relief conduit. Elements for establishing a pressure difference between the interior of the container and the interior of the liquid vessel are provided, including a channel adapted to be maintained at a pressure which is lower than that in the liquid vessel and higher than that of the outer atmosphere, and a branch conduit communicating the interior of the container with the interior of this channel. A one-way valve is arranged in the branch conduit and is operative for closing the same when the pressure in the channel increases and opening the same when the pressure in the channel decreases relative to the pressure in the interior of the container.

7 Claims, 4 Drawing Figures

MACHINE FOR THE FILLING OF LIQUIDS INTO CONTAINERS

CROSS-REFERENCE TO RELATED APPLICATIONS

This application is a continuation-in-part of the parent application Ser. No. 913,867 filed June 8, 1978 now U.S. Pat. No. 4,146,065.

The present application relates to a method and an arrangement for the filling of liquids into containers such as bottles and the like.

The application proceeds from a filling machine for the filling of liquids into containers such as bottles and the like, which includes a liquid annulus vessel and some filling components which are connected with the latter and which include a liquid input conduit and a pre-pressurizing and return gas conduit, as well as a relief conduit extending from the filling space outwardly, wherein an additional annular channel is arranged on the liquid annulus channel and a branch couduit commencing in the filling space communicates therewith.

In connection with the main application, there is provided a method and an arrangement for a time-controllable rapid filling, which is independently predeterminable from the pressure conditions in a system and which can be accomplished within a period that is time-predeterminable as well, while avoiding the possibility that disturbances, which occur due to the starting or running-in of a filling machine or interruptions of filling, could exercise an influence on the preselected rapid filling time, i.e. that a further extension of the rapid filling phase occurs beyond a certain liquid volume. Herein, it can be dispensed with control tracks that can be influenced from the outside, as well as with the provision of special control valves or control arrangements respectively individually within the individual valves.

SUMMARY OF THE INVENTION

Accordingly, it is an object of the present invention to further improve on these measures and to assure that no gas can reach the liquid container through the channels when pressure is increased or at the conclusion of the rapid filling phase, while avoiding the possibility that the gas exchange could be disturbed when pressure diminishes with respect to the filling space and, despite the incorporation of these elements, to assure that there is obtained an unproblematical circulatory rinsing in direction of the additional annular channel for the purpose of cleaning.

This object is achieved, in accordance with the present invention, in that means such as a one-way valve, which automatically closes when the pressure within the annular channel increases and which automatically opens when the pressure relative to the filling space decreases, is arranged in the branch conduit outside of the filling space.

It is further proposed that a one-way valve be arranged ahead of the additional valve which establishes the communication with the annular channel, as well as behind the same.

It has been found to be particularly advantageous when the one-way valve is arranged at the end of the conduit which leads into the annular channel.

In the following, the invention will be described in more detail with reference to an example of the embodiment which is illustrated in the drawing.

DESCRIPTION OF THE PREFERRED EMBODIMENTS

Figure 1:
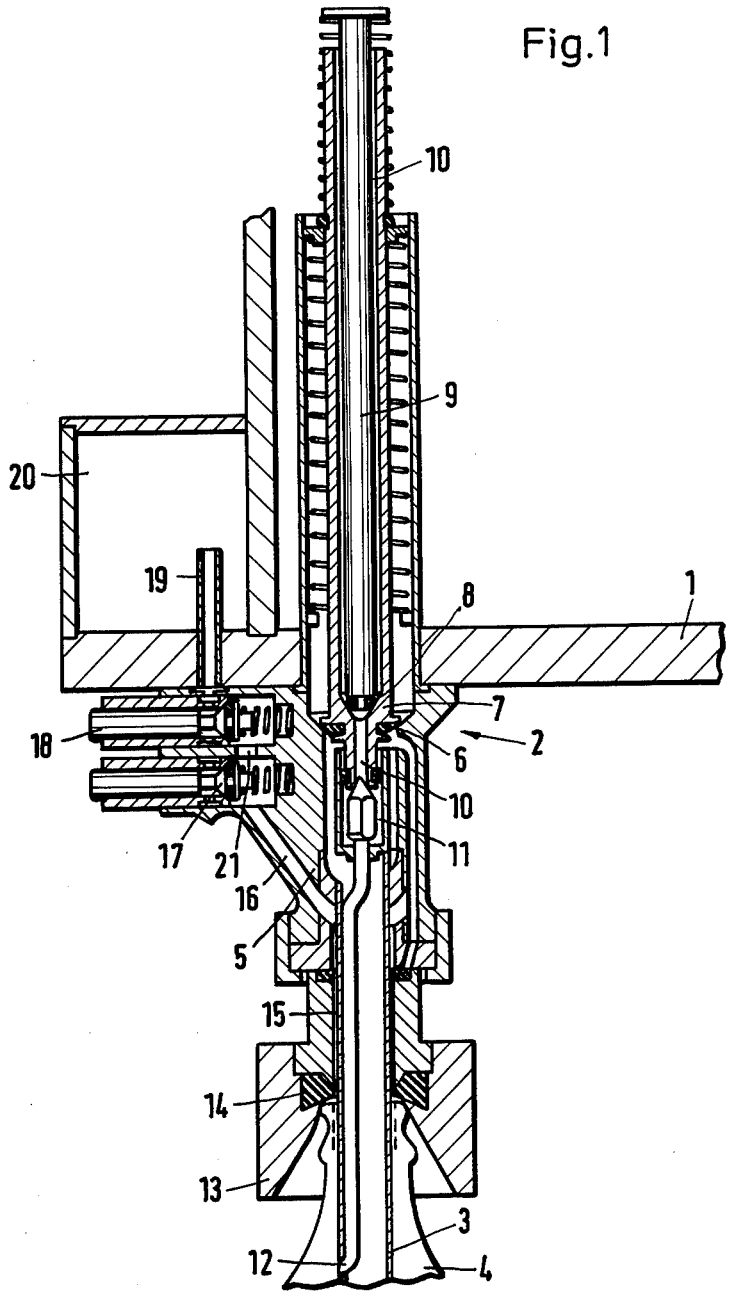
FIG. 1 shows a cross-section of the view of the valve or of a part of the filling machine, respectively.
Figure 3:
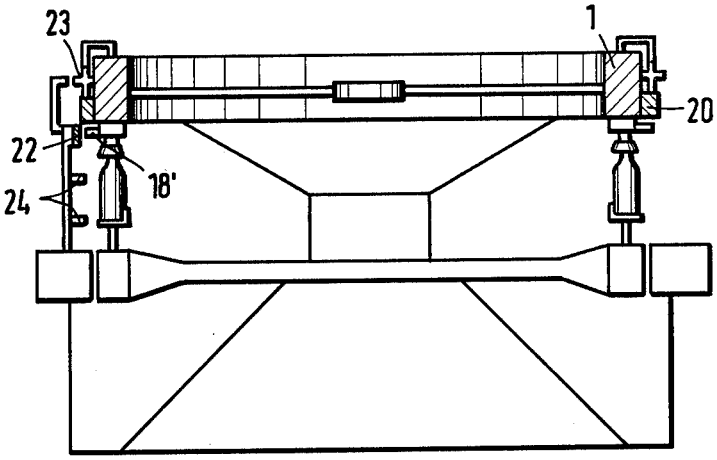
FIG. 3 is a partial cross-section according to FIG. 2.
Figure 2:
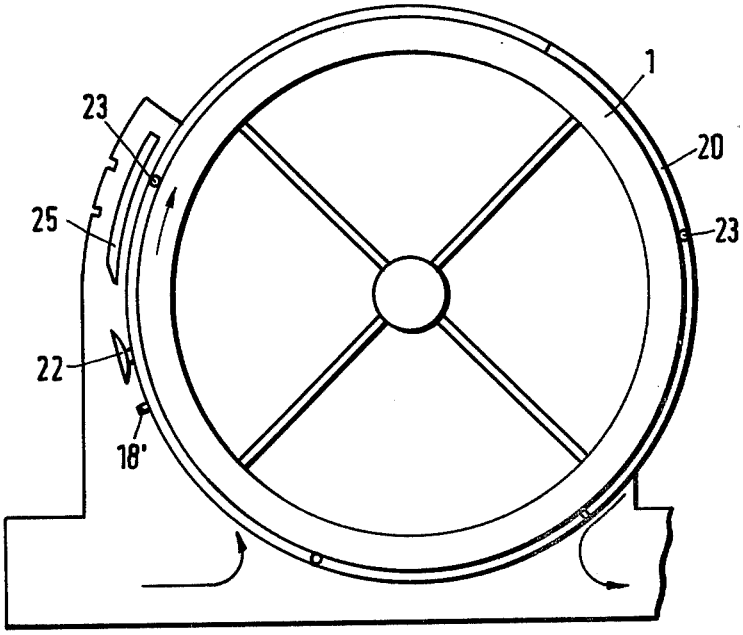
FIG. 2 is a top plan view of the filling machine.

According to the example of the embodiment which is illustrated in FIG. 1, the filling machine consists of a rotating liquid annulus vessel 1 with filling components 2, the filling pipe 3 proper of which protrudes downwardly and is introducible into a bottle 4, arranged thereat. The filling pipe 3 is rigidly connected with a control head 5. This also forms the valve seat 6, on which there rests the valve body 7 which is displaceable in the axial direction. A gas valve 8 with an outwardly conducted control rod 9 is arranged within the valve body. The valve body is penetrated by an advance and return gas conduit 10 which communicates with a float housing 11, from which the advance and return gas conduit leads all the way into the receptacle space. To this end, the filling pipe 3 is provided with a chamfer 12 which simultaneously determines the filling height proper. A centering element 13 with a seal 14 is guided in axial direction on the filling pipe 3. The same forms, together with the pressed-on receptacle and the control head, a space 15 which is sealed with respect to the atmosphere and which, in turn, communicates with a relief bore 16 and a relief valve 17. Moreover, a further valve 18 is arranged in the control head 5, from which a conduit 19 extends into an annular channel 20 which is additionally provided at the annular vessel 1. A further conduit 21 connects the valve space with the space 15 or with the bottle space. In this conduit, which is not illustrated in a greater detail, there can be additionally incorporated a float valve for the avoidance of the passage of the liquid from the space 16 into the annular channel 20. The pressure within the annular channel 20 is reduced with respect to the pressure which prevails in the annular vessel 1. The respective pressure conditions are pre-set in dependence on the beverage which is to be filled. However, the pressure prevailing in the annular channel 20 is higher than the atmospheric pressure.

The preparations for the performance of the filling operation are commenced with the opening of the gas valve 8. This occurs in that a control pinion, which is not illustrated in any great detail, and which is mounted in the annular channel 1, runs into contact with stationary control elements during the rotation of this vessel and lifts the control rod 9. As a resut of this, there is established a pressure equilibrium between the receptacle and the annular vessel 1, which opens the valve body 7 that is subjected to a spring pressure. At the same instant, the liquid flows, corresponding to the geodetic incline, into the receptacle. Now, as soon as a certain pre-filling of the bottle has been accomplished, the additional valve 18 which is arranged in the control head 5 is opened and communication is established with the annular channel 20 which is subjected to a minute pressure. In this manner, there comes into existence a differential pressure which permits a quicker inflow of the liquid. However, this rapid filling phase must not, especially in connection with beverages containing $CO_2$, last until the termination of the filling operation proper, inasmuch as otherwise, owing to the fact that the liquid flows in at an icreased speed, there would occur releases of gas which would result in an inaccurate filling. Moreover, partial liquid amounts would penetrate all the way to the conduits of the control head 5 and thus would influence the filling level after the relief of the pre-pressurized space 15 in an undefinable manner. As a result of this, the initially discussed advantages which result from the additional incorporation of a pressure chamber with a constant pressure, would again be frustrated. Therefore, it is necessary to perform this rapid filling phase within a predetermined time span, inasmuch as a predeterminable time span can be achieved, when a control track is incorporated at the circumference of the rotating filling machine and briefly actuates the valve 18, only when substantially the same throughput performance or rotational speed constantly prevail. However, this is not always possible. As a result of the changing conditions of the pre-arranged or after-arranged treatment machine, different throughput performances are often required of the filling machine.

Under normal conditions, the termination of the rapid filling phase is commenced as soon as the control track 22 is passed by the control bolt 18' of the valve 18 and the valve can close. This can also be achieved in such a manner that the control track 22, at the moment of emergency, is brought outside the region of the control bolt 18'. However, this switching mode is only advantageous in the event that a sudden interruption of the filling operation or a stillstand of the machine is perceived. Under usual conditions, the pressure in the receptacle to be filled is reduced after the commencement of the filling within a pre-determinable time and/or volume span, and increased after the expiration of the time span or after the achievement of the volume span and before the end of the filling operation proper, independently of the respective rotational speed or the throughput performance of the filling machine, in an automatic manner to the pre-pressurizing pressure prevailing in the system. Suitably, this is effected in that the pressure within the annular channel is built up, while the valve 18 is still open, with the achievement of a pre-determinable filling height upto the level of the liquid container pressure. To this end, the annular channel 20 is equipped with a pressure-regulating device 23 which is influenceable from the outside. For the influencing of this pressure regulating device 23, filling height sensing elements 24 are arranged in the region of the circular arc which constitutes the rapid filling zone of the rotating filling machine, and the control pulse which is issued by the same when a predeterminable filling height is reached acts on the pressure regulating device, which is connected with the annular channel, in a pressure-increasing sense, or establishes communication of the annular channel with the annular vessel 1. Thus can also occur in dependence on the speed of rotation of the filling machine by resorting to means which are known by themselves, for instance, a tachogenerator. As a result of this, the pressure within the annular channel 20 can be again built up, while the valve 18 is open, after the decrease below a pre-determinable throughput performance of the filling machine, within a pre-selectable time span. A suitable individual regulation of segment zones can be achieved in that the annular channel 20 consists of several zones and each partial zone is equipped, independently of one another, with a pressure regulating device 23 which can be activated as described above. Herein, the pulses can be transmitted by means of approach initiators 25 which can be brought into operative connection with the switching element of the pressure regulating device 23.

Figure 4:
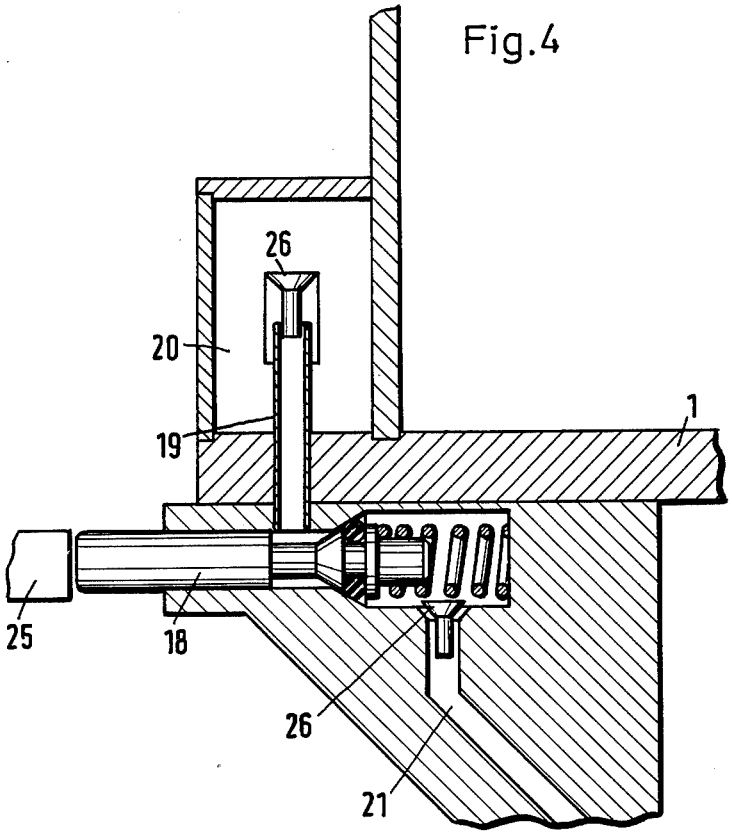
FIG. 4 shows the incorporation of the one-way valves.

According to the example of the embodiment which is illustrated in FIG. 4, there is located at the end of the conduit 19 which leads to the annular channel 20 an interposed one-way valve 26 which, when the pressure within the space 20 relative to that in the filling space increases, closes and thus prevents a gas exchange in direction of the liquid annulus vessel 1. As a result of this, the rapid filling phase is automatically terminated and the liquid is introduced into the bottle exclusively due to its geodetic incline, upto the elevation of the chamfer 12. Such a one-way valve 26 can be additionally arranged ahead of the valve 18 in the conduit 21. The construction of the one-way valve assures, on the one hand, a sudden penetration of the pressure into the filling space and permits, on the other hand, the flow of rinsing fluid in the opposite direction during the cleaning phase of the filling machine.

It will be understood that each of the elements described above, or two or more together, may also find a useful application in other types of constructions, differing from the types described above.

While the invention has been illustrated and described as embodied in a filling machine for filling of liquids into a container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features, that from the standpoint of prior art, fairly constitute essential characteristics of the generic and specific aspects of this invention.

What is claimed as new and desired to be protected by Letters Patent is set forth in the appended claims.

1. A filling machine for filling of liquids into a container, such as a bottle or the like, comprising a liquid vessel; filling elements operatively connected with said liquid vessel and including a liquid input conduit, an advance and return gas conduit, and a pressure relief conduit communicating the interior of the container with the outer atmosphere; means for establishing a pressure difference between the interior of the container and the interior of said liquid vessel, said establishing means including a channel adapted to be maintained at a pressure which is lower than that in said liquid vessel and higher than that of the outer atmosphere, and a branch conduit communicating the interior of the container with the interior of said channel; and means for automatically closing said branch conduit when the pressure in said channel increases and opening said branch conduit when the pressure in said channel decreases relative to the pressure in the interior of the container.

2. A filling machine as defined in claim 1, wherein said automatically closing and opening means is a one-way valve arranged in said branch conduit.

3. A filling machine as defined in claim 1, wherein said liquid inlet conduit is arranged to define together with the container a filling space, said one-way valve being arranged outside of said filling space.

4. A filling machine as defined in claim 1, wherein said liquid vessel is annular, said channel being also annular and arranged on said annular liquid vessel.

5. A filling machine as defined in claim 2; and further comprising an additional valve operative for establishing the communication between the interior of the container and the interior of said channel, said one-way valve being located downstream of said additional valve.

6. A filling machine as defined in claim 5, wherein said automatically closing and opening means further including a second such one-way valve, said second one-way valve being located upstream of said additional valve.

7. A filling machine as defined in claim 2, wherein said branch conduit extends into said channel and has an end section, said one-way valve being arranged in said end section of said branch conduit.

* * * * *